US005243390A

United States Patent [19]

Takemoto et al.

[11] Patent Number: 5,243,390

[45] Date of Patent: Sep. 7, 1993

[54] DEVICE FOR CONVEYING DEVELOPER IN A DEVELOPING DEVICE

[75] Inventors: Shinichi Takemoto, Toyokawa; Hirofumi Hasegawa, Hadano; Naoki Toyoshi, Toyohashi; Tateki Oka, Atsugi; Hiroshi Goto; Narutaka Yoshida, both of Machida, all of Japan

[73] Assignee: Minolta Camera Kabushiki Kaisha, Osaka, Japan

[21] Appl. No.: 935,344

[22] Filed: Aug. 28, 1992

Related U.S. Application Data

[63] Continuation of Ser. No. 721,308, Jun. 26, 1991, abandoned.

[30] Foreign Application Priority Data

Jun. 27, 1990 [JP] Japan ..... 2-169606

[51] Int. Cl.[5] ..... G03G 15/06

[52] U.S. Cl. ..... 355/245; 118/653; 118/656; 355/253

[58] Field of Search ..... 355/245, 260, 215, 253, 355/251; 118/653, 656, 657, 658; 222/DIG. 1

[56] References Cited

U.S. PATENT DOCUMENTS

| | | | |
|---|---|---|---|
| 4,344,692 | 8/1982 | Oda | 355/245 |
| 4,508,052 | 4/1985 | Kohyama | 118/651 |
| 4,572,631 | 2/1986 | Kondo | 355/253 |
| 4,583,834 | 4/1986 | Ohata et al. | 355/253 |
| 4,634,286 | 1/1987 | Pike | 118/657 X |
| 4,671,207 | 6/1987 | Hilbert | 118/657 |
| 4,748,471 | 5/1988 | Adkins | 118/657 X |
| 4,791,882 | 12/1988 | Enoguchi et al. | 118/653 |
| 4,878,603 | 11/1989 | Ikesue et al. | 355/245 X |
| 4,987,452 | 1/1991 | Nakagawa et al. | 355/245 |
| 4,993,829 | 2/1991 | Naganuma et al. | 355/245 X |

FOREIGN PATENT DOCUMENTS

| | | |
|---|---|---|
| 0366052 | 10/1989 | European Pat. Off. . |
| 0216190 | 3/1990 | European Pat. Off. . |
| 62-116261 | 7/1987 | Japan . |

*Primary Examiner*—A. T. Grimley
*Assistant Examiner*—William J. Royer
*Attorney, Agent, or Firm*—Burns, Doane, Swecker & Mathis

[57] ABSTRACT

A developing device for developing an electrostatic latent image formed on an electrostatic latent image support member comprises a developer supplying member for supplying a developer to the electrostatic latent image support member, a developer containing portion containing the developer to be supplied to the developer supplying member, a conveying member provided in the developer containing portion for conveying the developer above the bottom part of the developer containing portion to the developer supplying member with the developer in the bottom part of the developer containing portion being left, and an agitating member provided in the developer containing portion for agitating in the developer containing portion the developer remaining in the bottom part of the developer containing portion without being conveyed by the conveying member.

16 Claims, 7 Drawing Sheets

DEVICE FOR CONVEYING DEVELOPER IN A DEVELOPING DEVICE

This application is a continuation of application Ser. No. 07/721,308, filed Jun. 26, 1991, abandoned.

BACKGROUND OF THE INVENTION

1. Field of the Invention

The present invention relates generally to a developing device used for developing an electrostatic latent image formed on an electrostatic latent image support member in an image forming apparatus such as an electrophotographic copying machine or a printer, and more particularly, to a developing device so adapted that a developer is contained in a developer containing portion, the developer thus contained is fed into a developer supplying member by a conveying member provided in the developer containing portion, and the developer is conveyed to the electrostatic latent image support member by the developer supplying member to supply the developer to the electrostatic latent image support member from the developer supplying member.

2. Description of the Prior Art

Examples of a developing device for developing an electrostatic latent image formed on an electrostatic latent image support member conventionally used in an image forming apparatus such as an electrophotographic copying machine or a printer includes one so adapted that a developer is contained in a developer containing portion, the developer thus contained is supplied to a developer supplying member by a conveying member provided in the developer containing portion, and the developer is conveyed to an electrostatic latent image support member by the developer supplying member to supply the developer to the electrostatic latent image support member from the developer supplying member as described above.

In such a developing device, a controlling member is generally brought into contact with the surface of the developer supplying member supplied with the developer by the conveying member as described above by applying pressure to charge the developer supplied to the surface of the developer supplying member by triboelectric charging as well as to control the amount of the developer on the surface of the developer supplying member so as to charge the developer conveyed to the electrostatic latent image support member by the developer supplying member.

Toner particles having a suitable average particle diameter are generally used as a developer used in such a developing device. However, the particle diameters of all the toner particles are not the same. More specifically, toner particles having various particle diameters exist, that is, the toner particles having particle diameters smaller than to larger than the average particle diameter exist to have a predetermined distribution.

When the controlling member is brought into contact with the surface of the developer supplying member supplied with the developer by applying pressure as described above to charge the developer by triboelectric charging as well as to control the amount of the developer on the surface of the developer supplying member, therefore, the toner particles having larger particle diameters in the developer supplied to the surface of the developer supplying member are removed from the surface of the developer supplying member by the controlling member, so that the toner particles having smaller particle diameters in the developer are first used for the development.

Furthermore, when the controlling member is brought into contact with the surface of the developer supplying member supplied with the developer by applying pressure as described above, such a phenomenon also occurs that the developer supplied to the surface of the developer supplying member is reduced to fine powder and a post-treating agent is embedded into the developer to deteriorate the developer due to the contact of the controlling member by applying pressure.

As a result, as the development proceeds using the above described developing device, the toner particles having larger particle diameters in the developer remain, and the amount of the developer deteriorated due to the contact of the controlling member by applying pressure is also increased.

Therefore, when an image is formed using the above described developing device, the image formed is not fogged and the developer is not spilled from the developing device in the initial stages in which the toner particles having smaller particle diameters in the developer contained in the developer containing portion are consumed, thereby to make it possible to achieve good image formation. As the development proceeds, however, the toner particles having larger particle diameters in the developer and the developer deteriorated are supplied to the developer supplying member and used for the development, so that the developer is not properly charged, for example, to introduce some problems. For example, the image formed is fogged so that the quality of the image is lowered, and the developer is spilled from the developer supplying member or scattered so that the inside of the image forming apparatus is made dirty by the developer.

SUMMARY OF THE INVENTION

An object of the present invention is to prevent, in a developing device so adapted that a developer is contained in a developer containing portion, the developer thus contained is fed into a developer supplying member by a conveying member provided in the developer containing portion, and the developer is conveyed to an electrostatic latent image support member by the developer supplying member to supply the developer to the electrostatic latent image support member from the developer supplying member to develop an electrostatic latent image formed on the electrostatic latent image support member, toner particles having larger particle diameters in the developer or the developer deteriorated from being used for the development as the electrostatic latent image is developed.

The toner particles having larger particle diameters in the developer and the developer deteriorated are thus prevented from being used for the development, thereby to eliminate the possibilities that the image formed is fogged and the developer is spilled from the developing device or scattered so that the inside of the image forming apparatus is made dirty by the developer.

In the present invention, a developing device for developing an electrostatic latent image formed on an electrostatic latent image support member comprises a developer supplying member for supplying a developer to the above electrostatic latent image support member, a developer containing portion containing the developer to be supplied to the above developer supplying member, a conveying member provided in the above developer containing portion for conveying the developer above the bottom part of the developer containing portion to the above developer supplying member with the developer in the bottom part of the developer containing portion being left, and an agitating member provided in the above developer containing portion for agitating in the developer containing portion the developer remaining in the bottom part of the developer containing portion without being conveyed by the conveying member.

The developer above the bottom part of the developer containing portion in the developer contained in the developer containing portion is conveyed to the developer supplying member by the above conveying member with the developer in the bottom part of the developer containing portion being left. The developer thus conveyed is supplied to the electrostatic latent image support member from the developer supplying member to develop the electrostatic latent image formed on the electrostatic latent image support member.

Furthermore, the developer remaining in the bottom part of the developer containing portion without being conveyed by the conveying member is agitated and mixed with the rest in the developer containing portion by the above agitating member.

When the electrostatic latent image is thus developed, the developer is contained in the developer containing portion with toner particles having various particle diameters in the developer being distributed at the beginning. However, the toner particles having smaller particle diameters in the developer are first used by the development. Accordingly, in the developer containing portion, the percentage of the toner particles having smaller particle diameters in the developer is decreased while the percentage of the toner particles having larger particle diameters in the developer is increased.

Furthermore, even if the toner particles having smaller particle diameters in the developer exist in the bottom part of the developer containing portion and are not conveyed to the developer supplying member by the above conveying member at the beginning, the toner particles having smaller particle diameters in the developer are agitated and mixed with the other toner particles in the developer in the developer containing portion by the above agitating member and are gradually conveyed to the developer supplying member from the developer containing portion by the above conveying member, to be used for the development.

At the time point where development is repeated many times so that the amount of the developer in the developer containing portion is decreased, therefore, the toner particles having larger particle diameters in the developer remain in the bottom part of the developer containing portion. The toner particles having larger particle diameters in the developer thus remaining remain to the last in the bottom part of the developer containing portion without being supplied to the developer supplying member by the conveying member, not to be used for the development.

Furthermore, when a part of the developer is deteriorated while the electrostatic latent image is being developed in the above described manner, the developer thus deteriorated remains to some extent in the bottom part of the developer containing portion. Consequently, the developer deteriorated is not all used for the development.

As a result, when the amount of the developer in the developer containing portion is decreased, the toner particles having larger particle diameters in the developer and the developer deteriorated are not used for the development, to eliminate the possibilities that the image formed is fogged and the developer is spilled from the developer supplying member or scattered.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiment 1

Figure 1:
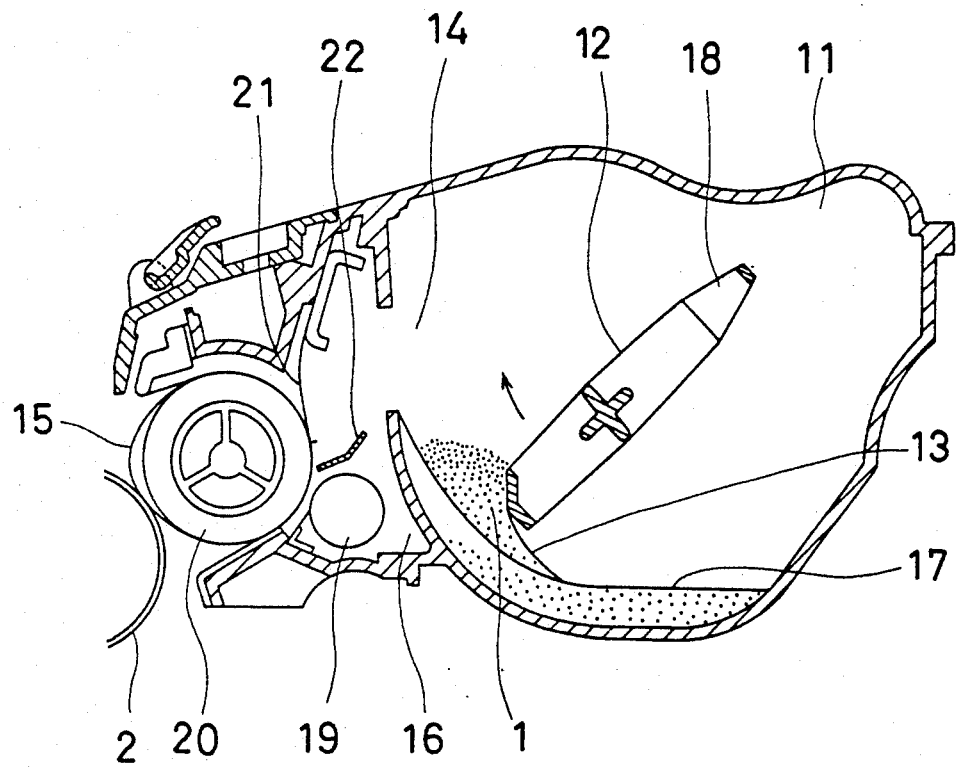
FIG. 1 is a schematic cross sectional view showing a state where a developing device according to an embodiment 1 of the present invention is used.
Figure 2:
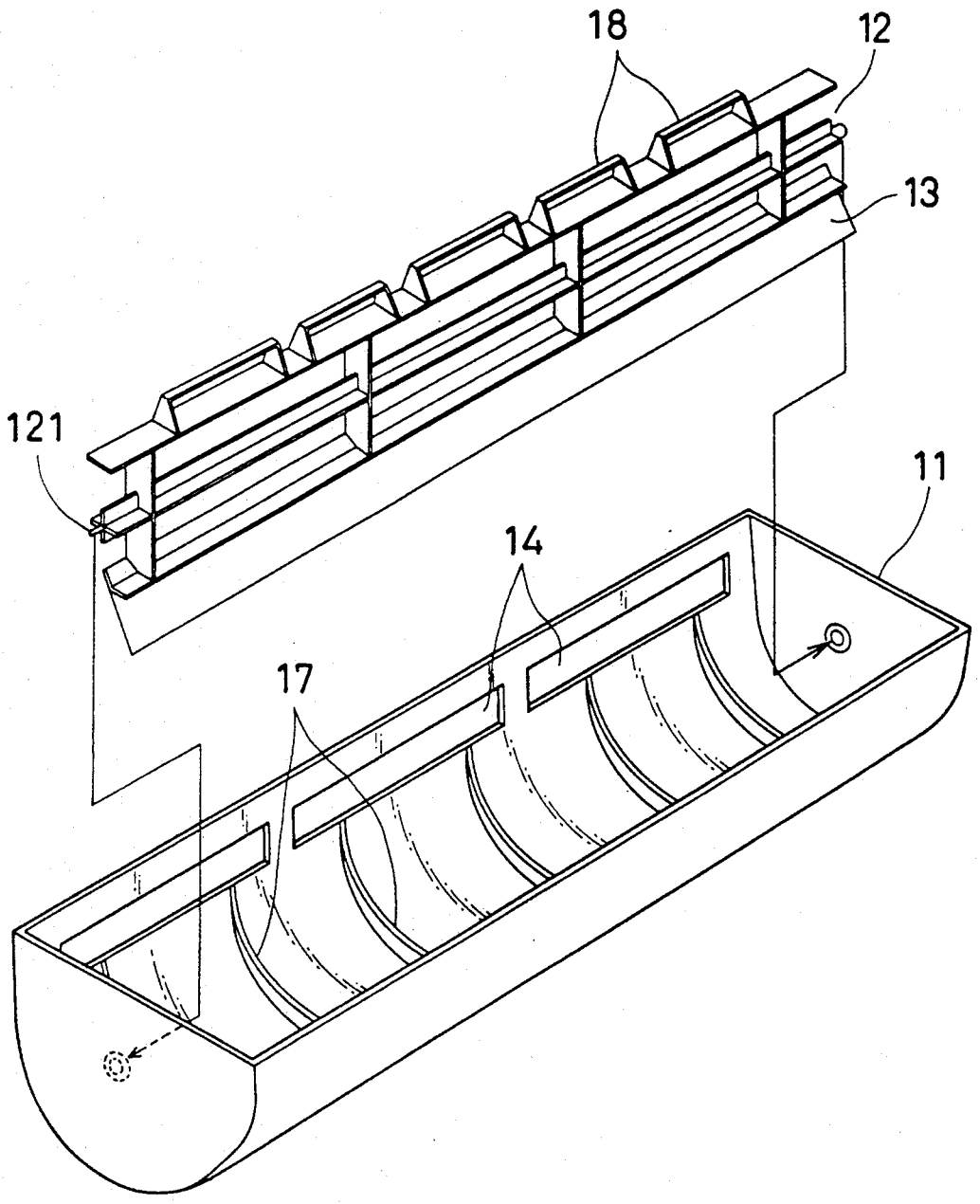
FIG. 2 is a perspective view showing the inside of a developer containing portion in the developing device according to the embodiment 1 and a rotating member provided in the developer containing portion.
Figure 3:
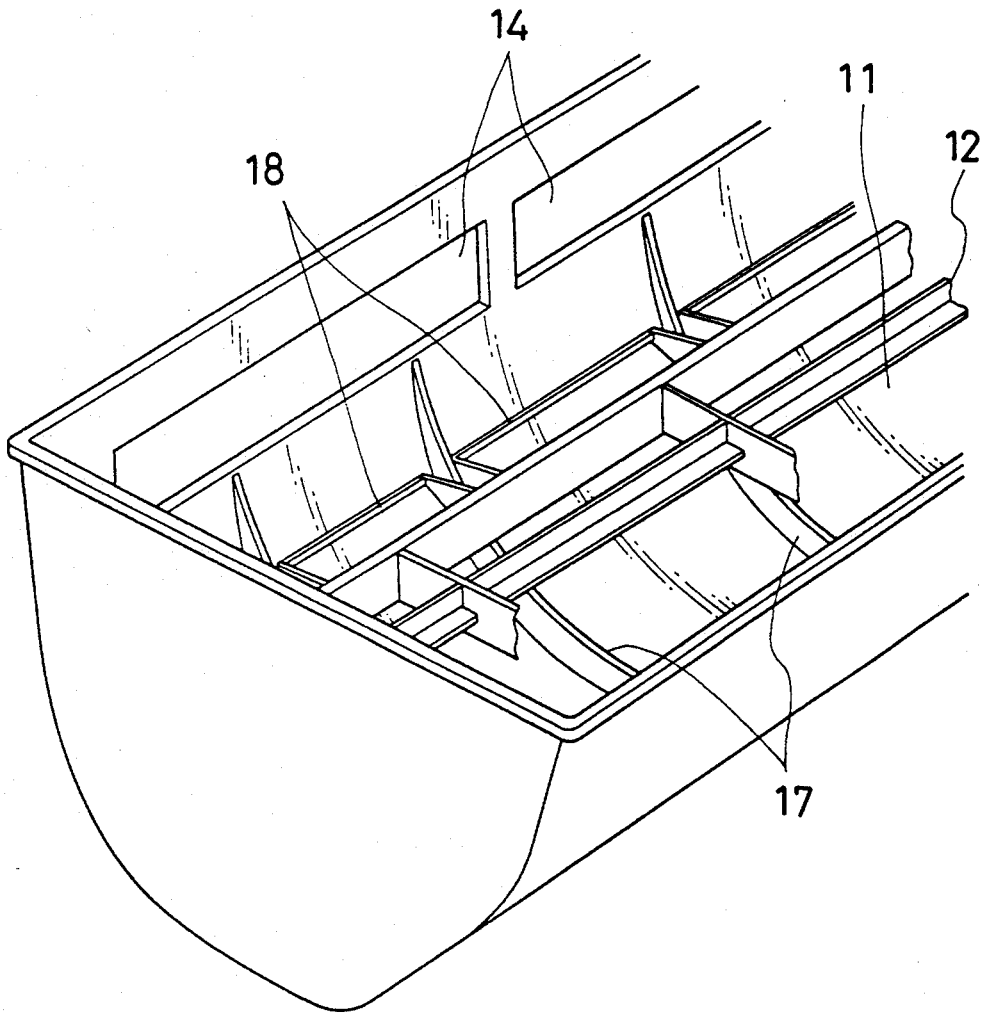
FIG. 3 is an perspective view showing a state where a developer remaining in the bottom part of the developer containing portion is agitated by an agitating member in the developing device according to the embodiment 1.

In a developing device according to an embodiment 1 shown in FIGS. 1 to 3, a developer 1 is contained in a developer containing portion 11. In addition, there is provided in the above developer containing portion 11 a rotating member 12 extending on both sides in the radial direction of an axis of rotation 121 centered with respect to the axis of rotation 121 in the longitudinal direction of the developer containing portion 11, that is, in the direction crossing at right angles to such a direction as to feed the developer 1 so that the rotating member 12 is rotated in such a direction as to feed the developer 1 about the axis of rotation 121 in the toner containing portion 11.

Furthermore, a conveying blade 13 made of a flexible elastic material is attached as conveying means to one end of the above rotating member 12 in the radial direction of the axis of rotation 121 so as to extend outward in the radial direction so that the conveying blade 13 is rotated in the developer containing portion 11 as the above rotating member 12 is rotated. The developer 1 contained in the developer containing portion 11 is fed into a developer supplying portion 16 located on the side of a developer supplying member 15 through a developer supply port 14 by the conveying blade 13 which is thus rotated.

Additionally, a required number of ribs 17 projected upward from the bottom part of the above developer containing portion 11 and extending from the bottom part of the developer containing portion 11 to the above developer supply port 14 along the direction of rotation of the conveying blade 13 are provided with constant spacing as preventing means for preventing the developer 1 in the bottom part of the developer containing portion 11 from being fed into the developer supplying portion 16 by the above conveying blade 13. When the ribs 17 are thus provided in the bottom part of the developer containing portion 11, the conveying blade 13 which is rotated is deflected by striking the ribs 17 and thus, is not brought into contact with the bottom part of the developer containing portion 11. Accordingly, the developer 1 in the bottom part of the developer containing portion 11 remains between the ribs 17 without being fed into the developer supplying portion 16 by the conveying blade 13.

Furthermore, as an agitating member for agitating in the developer containing portion 11 the developer 1 thus remaining between the ribs 17, a plurality of channel members 18 are attached to a side end of the above rotating member 12 on the opposite side of the conveying blade 13 in the radial direction of the axis of rotation 121 so as to extend outward in the radial direction so that the channel members 18 are rotated in the developer containing portion 11 as the above rotating member 12 is rotated. The width of each of the above channel members 18 is made slightly smaller than the spacing between the above ribs 17. The channel members 18 are rotated as the rotating member 12 is rotated as described above and each of the channel members 18 is passed between the above ribs 17, to agitate in the developer containing portion 11 the developer 1 remaining between the ribs 17.

Moreover, a feed roller 19 is provided in the developer supplying portion 16 into which the developer 1 is fed by the conveying blade 13 as described above, to supply the developer 1 fed into the developer supplying portion 16 to the surface of the developer supplying member 15. Used as the developer supplying member 15 is one in a sleeve shape having a larger diameter than of a drive roller 20 and made of a flexible material. The developer supplying member 15 is provided on the side of the outer periphery of the drive roller 20. The developer supplying member 15 is brought into contact with the outer periphery of the drive roller 20 by applying pressure with the developer supplying member 15 being projected toward an electrostatic latent image support member 2 from the drive roller 20 in a portion, which is opposed to the electrostatic latent image support member 2, of the developer supplying member 15. The developer supplying member 15 projected toward the electrostatic latent image support member 2 is rotated and is brought into contact with the surface of the electrostatic latent image support member 2.

The developer supplying member 15 is rotated as the above drive roller 20 is rotated, to convey the developer 1 supplied to the surface of the developer supplying member 15 by the above feed roller 19 to the electrostatic latent image support member 2 having an electrostatic latent image formed thereon.

A controlling member 21 is brought into contact with the surface of the developer supplying member 15 by applying pressure while the developer 1 is being conveyed to the electrostatic latent image support member 2 by the developer supplying member 15, to control the amount of the developer 1 conveyed by the developer supplying member 15 as well as to charge the developer 1 conveyed by triboelectric charging. When the amount of the developer 1 conveyed by the developer supplying member 15 is thus controlled by the controlling member 21, toner particles having smaller particle diameters in the developer 1 pass through the controlling member 21, while toner particles having larger particle diameters in the developer 1 are removed from the surface of the developer supplying member 15 by the controlling member 21.

A guide plate 22 extending from the position slightly lower than the position where the above controlling member 21 is brought into contact with the surface of the developer supplying member 15 by applying pressure toward the above developer supply port 14 is provided as returning member for returning to the developer containing portion the toner particles having a larger particle diameter in the developer 1 which are thus removed from the surface of the developer supplying member 15 by the controlling member 21.

The toner particles having larger particle diameters in the developer 1 which are removed from the developer supplying member 15 by the above controlling member 21 and the developer 1 deteriorated by the contact of the controlling member 21 by applying pressure are introduced into the developer supply port 14 through the guide plate 22, to be returned to the developer containing portion 11 from the developer supply port 14.

Furthermore, the developer 1 which is passed through the controlling member 21 to be charged by triboelectric charging as described above is introduced into a portion, which is opposed to the electrostatic latent image support member 2, of the developer supplying member 15 by the above developer supplying member 15. In the portion, which is opposed to the electrostatic latent image support member 2, of the developer supplying member 15, the developer supplying member 15 is brought into contact with the surface of the electrostatic latent image support member 2 to supply the developer 1 charged to the electrostatic latent image support member 2 from the developer supplying member 15 to develop an electrostatic latent image formed on the electrostatic latent image support member 2 using the developer 1.

If development is thus repeated, toner particles in the developer 1 are used for the development in the order of increasing particle diameters and the toner particles having larger particle diameters in the developer 1 are returned to the developer containing portion 11 from the developer supply port 14 by the guide plate 22 as described above. If such an operation is repeatedly performed many times, the percentage of the toner particles having larger particle diameters in the developer 1 in the developer containing portion 11 is gradually increased. In addition, the developer 1 deteriorated by the contact of the controlling member 21 by applying pressure as described above is returned to the developer containing portion 11, so that the percentage of the developer 1 deteriorated in the developer containing portion 11 is also increased.

When the developer 1 contained in the developer containing portion 11 is sequentially consumed in the above described manner, to decrease the amount of the developer 1 in the developer containing portion 11 as well as to increase the percentage of the toner particles having larger particle diameters in the developer 1 and the developer 1 deteriorated in the developer containing portion 11, the above ribs 17 prevent the developer 1 from being fed by the conveying blade 13. Accordingly, the developer 1 is not supplied to the developer supplying member 15 with the toner particles having larger particle diameters in the developer 1 and the developer 1 deteriorated remaining between the ribs 17 in the developer containing portion 11.

In the developing device, therefore, the toner particles having larger particle diameters in the developer 1 and the developer 1 deteriorated are not all supplied to the developer supplying member 15 and used for the development, to reduce the possibilities that the image formed is fogged and the developer are spilled from the developer supplying member 15 or scattered.

Embodiment 2

Figure 4:
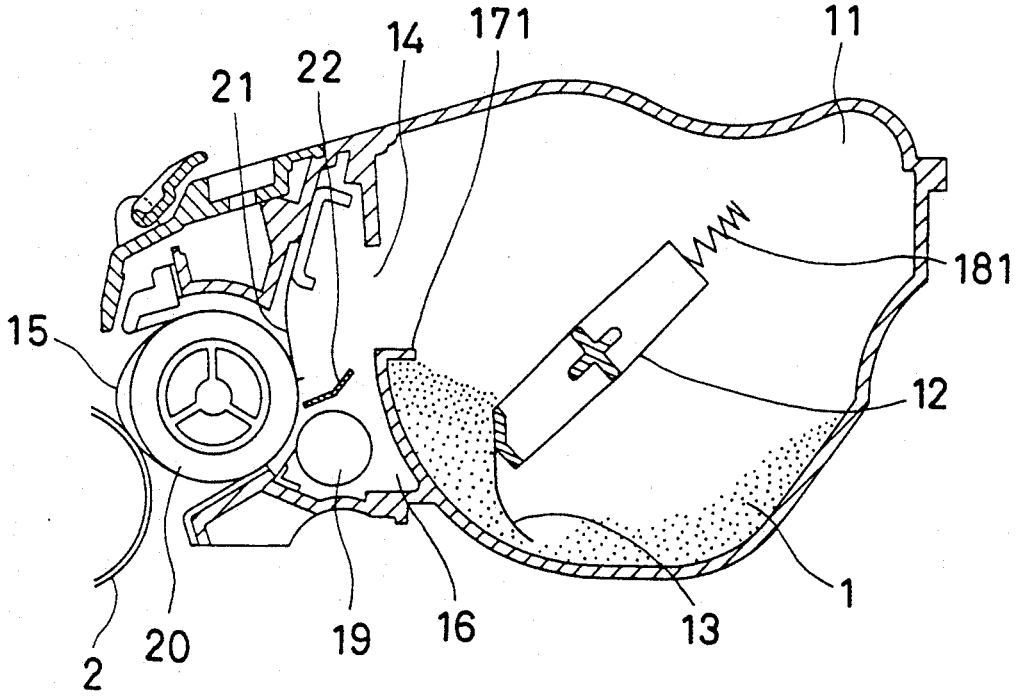
FIG. 4 is a schematic cross sectional view showing a state where a developing device according to an embodiment 2 of the present invention is used.
Figure 5:
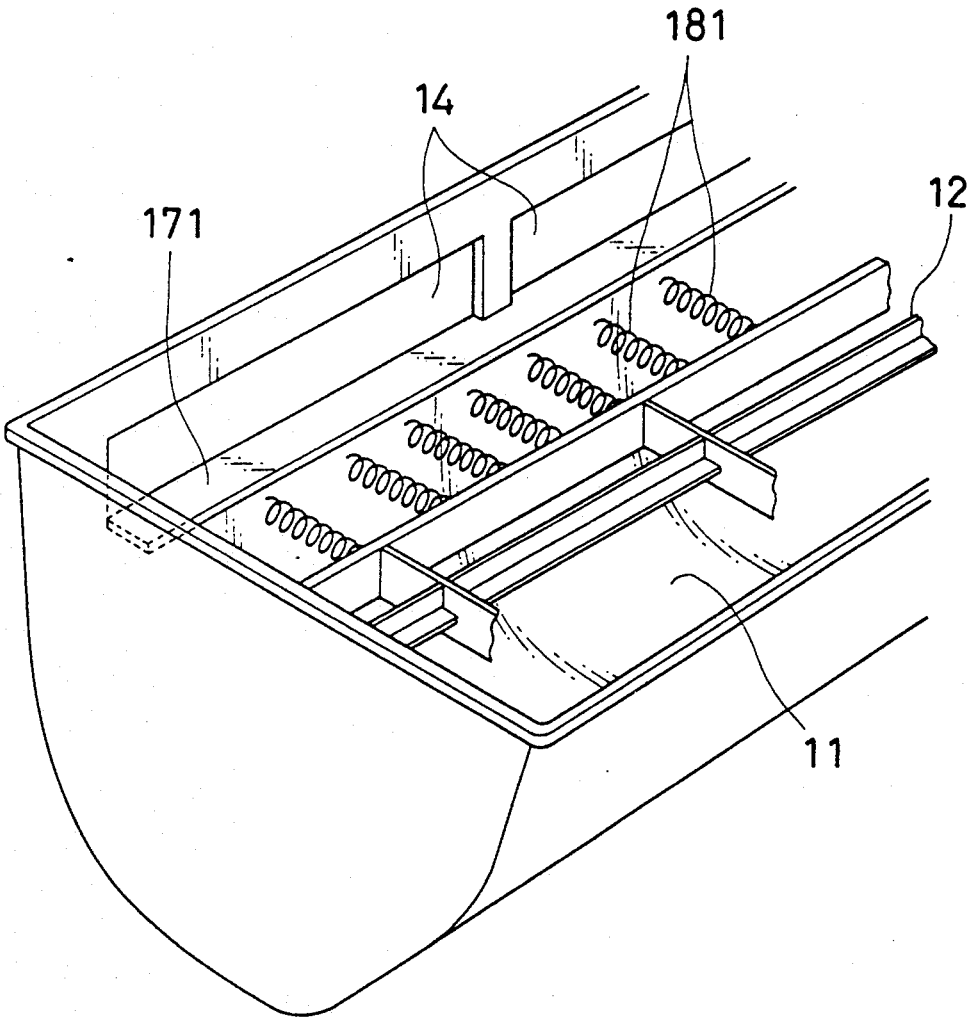
FIG. 5 is a perspective view showing a state where a developer remaining in the bottom part of a developer containing portion is agitated by an agitating member in the developing device according to the embodiment 2.

A developing device according to an embodiment 2 is approximately the same as the developing device according to the above described embodiment 1 except for the following. More specifically, in the developing device according to the present embodiment, a preventing plate 171 projected toward a developer containing portion 11 along a lower edge of a developer supply port 14 for feeding the developer 1 into a developer supplying portion 16 is provided, as shown in FIGS. 4 and 5, as preventing means for preventing the developer 1 in the bottom part of the developer containing portion 11 from being fed into the developer supplying portion 16 by a conveying blade 13. When such a preventing plate 171 is provided, the conveying blade 13 which is rotated is deflected by striking the preventing plate 171, and the developer 1 in the bottom part of the developer containing portion 11 is stopped in front of the developer supply port 14 by the preventing plate 171 and remains in the developer containing portion 11 without being fed into the developer supplying portion 16.

Furthermore, a plurality of springs 181 are attached to an end of the above rotating member 12 on the opposite side of the conveying blade 13 in the radial direction of an axis of rotation so as to extend outward in the radial direction as an agitating member for agitating in the developer containing portion 11 the developer 1 which is stopped by the above preventing plate 171 and remains in the bottom part of the developer containing portion 11. Each of the springs 181 is rotated in the developer containing portion 11 as the rotating member 12 is rotated, to agitate in the developer containing portion 11 the developer 1 remaining in the bottom part of the developer containing portion 11 as described above.

Also in the developing device according to the present embodiment, the preventing plate 171 projected as described above prevents the developer 1 from being fed into the developer supplying portion 16 by the above conveying blade 13. Consequently, the developer 1 is not supplied to the developer supplying member 15 with the toner particles having larger particle diameters in the developer 1 and the developer 1 deteriorated remaining in the developer containing portion 11.

As a result, also in the developing device according to the present embodiment, the toner particles having larger particle diameters in the developer 1 and the developer 1 deteriorated are not all supplied to the developer supplying member 15 and used for the development, to reduce the possibilities that an image formed is fogged and the developer is spilled from the developer supplying member 15 or scattered.

Embodiment 3

Figure 6:
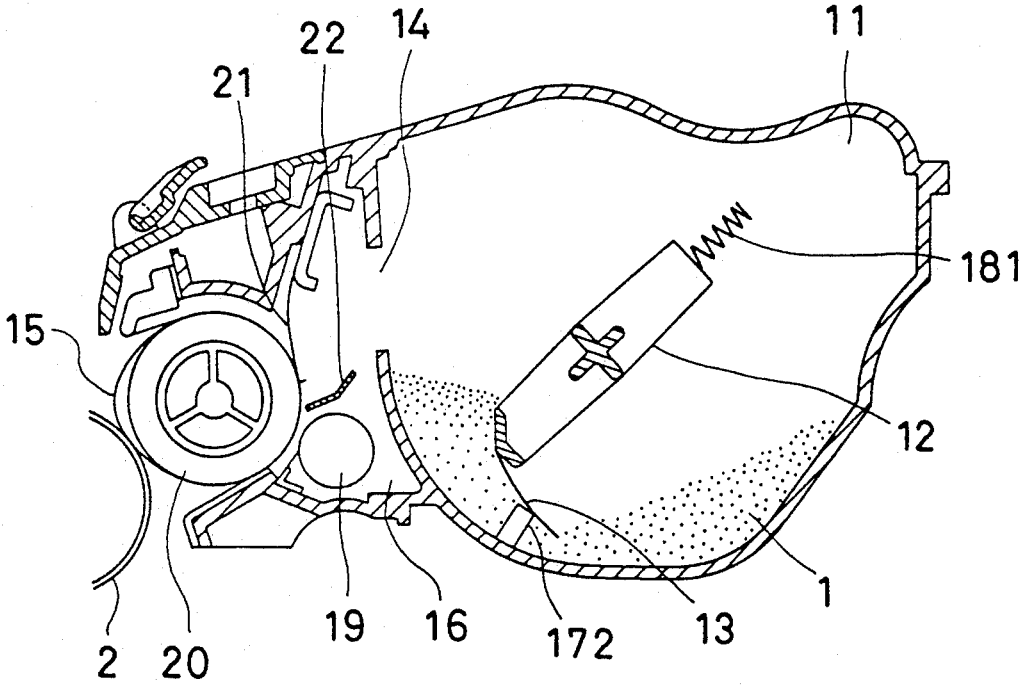
FIG. 6 is a schematic cross sectional view showing a state where a developing device according to an embodiment 3 of the present invention is used.
Figure 7:
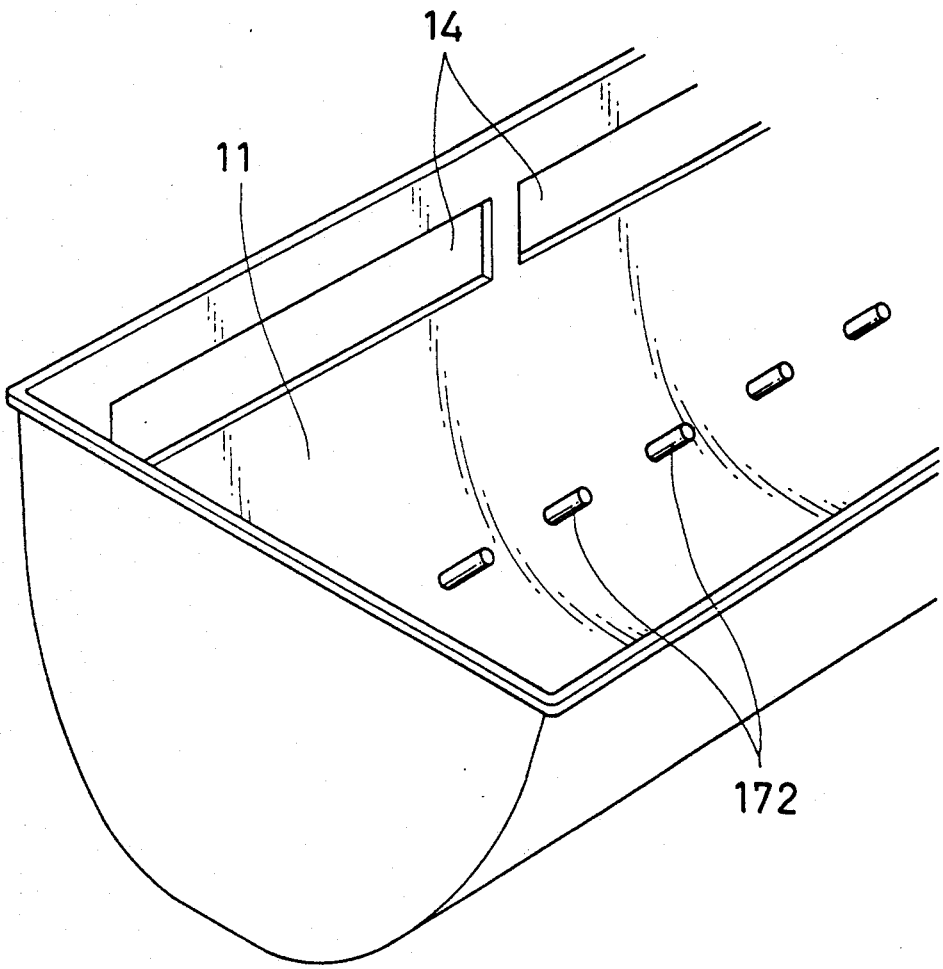
FIG. 7 is a perspective view showing the inside of a developer containing portion in the developing device according to the embodiment 3.

A developing device according to an embodiment 3 is also approximately the same as the developing devices according to the above described embodiments except for the following. More specifically, in the developing device according to the present embodiment, a plurality of pins 172 projected upward from the bottom part of a developer containing portion 11 are provided with constant spacing in the longitudinal direction of the developer containing portion 11, as shown in FIGS. 6 and 7, as preventing means for preventing a developer 1 in the bottom part of the developer containing portion 11 from being fed into a developer supplying portion 16 by a conveying blade 13. When a plurality of pins 172 projected upward from the bottom part of the developer containing portion 11 are thus provided, the conveying blade 13 which is rotated is deflected by striking the pins 172 and thus, is not brought into contact with the bottom part of the developer containing portion 11 in the vicinity of the pins 172. Consequently, the developer 1 remains in the vicinity of the pins 172.

Furthermore, a plurality of springs 181 are attached to an end of a rotating member 12 on the opposite side of the conveying blade 13 in the radial direction of an axis of rotation so as to extend outward in the radial direction as an agitating member for agitating in the developer containing portion 11 the developer 1 remaining due to the pins 172, as in the developing device according to the above described embodiment 2. Each of the springs 181 is rotated in the developer containing portion 11 as the rotating member 12 is rotated, to agitate in the developer containing portion 11 the developer 1 remaining in the bottom part of the developer containing portion 11 as described above.

Also in the developing device according to the present embodiment, the pins 172 projected as described above prevent the developer 1 from being fed into the developer supplying portion 16 by the above conveying blade 13. Accordingly, the developer 1 is not supplied to the developer supplying member 15 with toner particles having larger particle diameters in the developer 1 and the developer 1 deteriorated remaining in the developer containing portion 11.

As a result, also in the developing device according to the present embodiment, the toner particles having larger particle diameters in the developer 1 and the developer 1 deteriorated are not all supplied to the developer supplying member 15 and used for the development, to reduce the possibilities that an image formed is fogged and the developer is spilled from the developer supplying member 15 or scattered.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A developing device for developing an electrostatic latent image formed on an electrostatic latent image support member, comprising:

developer supplying means for supplying a developer to said electrostatic latent image support member;

a developer containing portion containing the developer to be supplied to said developer supplying means;

a rotating member which is rotated about an axis of rotation in said developer containing portion;

a conveying member attached to an end of said rotating member in the radial direction of the axis of rotation for conveying the developer above the bottom part of the developer containing portion to said developer supplying means with the developer in the bottom part of the developer containing portion being left; and an agitating member attached to an end of the rotating member on the opposite side of said conveying member in the radial direction of the axis of rotation for agitating in the developer containing portion the developer remaining in the bottom part of the developer containing portion without being conveyed by the conveying member.

2. A developing device for developing an electrostatic latent image formed on an electrostatic latent image support member, comprising:

developer supplying means for supplying a developer to said electrostatic latent image support member;

a developer containing portion containing the developer to be supplied to said developer supplying means;

a rotating member which is rotated about an axis of rotation in said developer containing portion;

a conveying member provided on said rotating member so as to extend outward in a radial direction of the axis for conveying the developer to the developer supplying means; and an agitating member provided on said rotating member so as to extend outward in a radial direction of the axis for agitating the developer in the developer containing portion without conveying the developer to the developer supplying means.

3. A developing device for developing an electrostatic latent image formed on an electrostatic latent image support member, comprising:

developer supplying means for supplying a developer to said electrostatic latent image support member;

a developer containing portion containing the developer to be supplied to said developer supplying means said developer containing portion having a bottom part;

a rotating member which is rotated about an axis of rotation in said developer containing portion;

a conveying member provided on said rotating member so as to extend outward in a radial direction of the axis for conveying the developer above the bottom part of the developer containing portion to said developer supplying means while leaving the developer in the bottom part of the developer containing portion; and an agitating member provided on said rotating member so as to extend outward in a radial direction of the axis for agitating the developer remaining in the bottom part of the developer containing portion without conveying the developer to the developer supplying means.

4. A developing device for developing an electrostatic latent image formed on an electrostatic latent image support member, comprising:

developer supplying means for supplying a developer to said electrostatic latent image support member;

a developer containing portion containing the developer to be supplied to said developer supplying means said developer containing portion having a bottom part;

a rotating member which is rotated about an axis of rotation in said developer containing portion;

a conveying member provided on said rotating member so as to extend outward in a radial direction of the axis for conveying the developer contained in the developer containing portion to the developer supplying means so that the developer in the bottom part of the developer containing portion is to be left;

an agitating member provided on said rotating member so as to extend outward in a radial direction of the axis for agitating the developer remaining in the bottom part of the developer containing portion without conveying the developer to the developer supplying means; and preventing means for preventing the developer in the bottom part of the developer containing portion from being conveyed to the developer supplying means by said conveying member.

5. The developing device according to claim 4, wherein said conveying member comprises a flexible member.

6. The developing device according to claim 4, wherein said agitating member comprises springs.

7. The developing device according to claim 4, wherein said preventing means comprises pins projected upward from the bottom part of the developer containing portion.

8. The developing device according to claim 4, wherein said preventing means comprises a member projecting into the developer containing portion in a portion where the developer is introduced into the developer supplying means from the developer containing portion.

9. The developing device according to claim 4, wherein said preventing means comprises ribs projecting upward from the bottom part of the developer containing portion and extending in such a direction as to feed the developer into the developer supplying means.

10. The developing device according to claim 9, wherein the agitating member for agitating the developer remaining between said ribs is a channel member.

11. A developing device for developing an electrostatic latent image formed on an electrostatic latent image support member, comprising:

developer supplying means for supplying a developer to said electrostatic latent image support member;

a developer containing portion containing the developer to be supplied to said developer supplying means;

controlling means which is brought into contact with a surface of said developer supplying means for controlling an amount of the developer on the surface of the developer supplying means;

a rotating member which is rotated about an axis of rotation in said developer containing portion;

a conveying member provided on said rotating member so as to extend outward in a radial direction of the axis for conveying the developer to the developer supplying means; and an agitating member provided on said rotating member so as to extend outward in a radial direction of the axis for agitating the developer in the developer containing portion without conveying the developer to the developer supplying means.

12. A developing device for developing an electrostatic latent image formed on an electrostatic latent image support member, comprising:

developer supplying means for supplying developer to said electrostatic latent image support member;

a developer containing portion containing the developer to be supplied to said developer supplying means, said developer containing portion having a bottom part;

a rotating member which is rotated about an axis of rotation in said developer containing portion;

a conveying member provided on said rotating member so as to extend outward in a radial direction of the axis for conveying the developer contained in the developer containing portion to the developer supplying means; and preventing means for preventing the developer in the bottom part of the developer containing portion from being conveyed to the developer supplying means by said conveying member.

13. The developing device according to claim 12, wherein said preventing means comprises pins projecting upward from the bottom part of the developer containing portion.

14. The developing device according to claim 12, wherein said preventing means comprises a member projecting into the developer containing portion in a portion where the developer is introduced into the developer supplying means from the developer containing portion.

15. The developing device according to claim 12, wherein said preventing means comprises ribs projecting upward from the bottom part of the developer containing portion and extending in such a direction as to feed the developer into the developer supplying means.

16. A developing device for developing an electrostatic latent image formed on an electrostatic latent image support member, comprising:

developer supplying means provided with a rotating sleeve confronting said electrostatic latent image support member for supplying a developer to said electrostatic latent image support member;

a developer supplying portion accommodating said rotating sleeve;

a developer containing portion containing the developer to be supplied to said developer supplying portion, said developer containing portion being in communication with the developer supplying portion by a developer supply port;

controlling means which is brought into contact with a surface of said rotating sleeve in the developer supplying portion for controlling an amount of the developer on the surface of the rotating sleeve;

a conveying member provided in the developer containing portion for conveying the developer contained in the developer containing portion to the developer supplying portion through the developer supply port;

an agitating member provided in said developer containing portion for agitating developer remaining in a bottom part of said developer containing portion that is not conveyed by the conveying member; and a returning member extending from a first position where the controlling means contacts the surface of the rotating sleeve to a second position which is adjacent to the developer supply port so that the developer scraped off by the controlling means is returned to the developer containing portion through the developer supply port.

* * * * *